US005844370A

United States Patent [19]

Cathey et al.

[11] Patent Number: 5,844,370

[45] Date of Patent: Dec. 1, 1998

[54] MATRIX ADDRESSABLE DISPLAY WITH ELECTROSTATIC DISCHARGE PROTECTION

[75] Inventors: David A. Cathey; Glen E. Hush; Manny K. F. Ma; Craig M. Dunham; David A. Zimlich, all of Boise, Id.

[73] Assignee: Micron Technology, Inc., Boise, Id.

[21] Appl. No.: 706,295

[22] Filed: Sep. 4, 1996

[51] Int. Cl.[6] ..... H01J 19/24

[52] U.S. Cl. ..... 315/169.1; 315/169.3; 313/496; 361/56

[58] Field of Search ..... 315/169.1, 169.2, 315/169.3; 313/309, 336, 351, 496; 361/56

[56] References Cited

U.S. PATENT DOCUMENTS

| | | | |
|---|---|---|---|
| 3,712,995 | 1/1973 | Steudel | 361/56 |
| 3,921,078 | 11/1975 | Aihara et al. | 313/336 X |
| 5,015,912 | 5/1991 | Spindt et al. | 315/169.3 X |
| 5,019,002 | 5/1991 | Holmberg | 445/24 |
| 5,103,144 | 4/1992 | Dunham | 315/366 |
| 5,153,483 | 10/1992 | Kishino et al. | 315/3 |
| 5,162,704 | 11/1992 | Kobori et al. | 315/349 |
| 5,210,472 | 5/1993 | Casper et al. | 315/349 |
| 5,212,426 | 5/1993 | Kane | 315/169.1 |
| 5,359,256 | 10/1994 | Gray | 313/169 |
| 5,442,193 | 8/1995 | Jaskie et al. | 313/336 X |
| 5,500,546 | 3/1996 | Marum et al. | 361/56 X |
| 5,528,108 | 6/1996 | Cisneros | 315/169.1 X |
| 5,682,085 | 10/1997 | Suzuki et al. | 315/169.1 |

FOREIGN PATENT DOCUMENTS

| | | |
|---|---|---|
| 0 589 523 A1 | 3/1994 | European Pat. Off. . |
| 06232332 | 8/1994 | Japan . |
| 07302876 | 11/1995 | Japan . |

OTHER PUBLICATIONS

David A. Cathey, Jr., "Field Emission Displays," undated internal document.

*Primary Examiner*—Benny Lee
*Assistant Examiner*—Justin P. Bettendorf
*Attorney, Agent, or Firm*—Seed and Berry LLP

[57] ABSTRACT

A field emission display includes electrostatic discharge protection circuits coupled to an emitter substrate and an extraction grid. In the preferred embodiment, the electrostatic discharge circuit includes diodes reverse biased between grid sections and a first reference potential or between row lines and a second reference potential. The diodes provide a current path to discharge static voltage and thereby prevent a high voltage differential from being maintained between the emitter sets and the extraction grids. The diodes thereby prevent the emitter sets from emitting electrons at a high rate that may damage or destroy the emitter sets. In one embodiment, the diodes are coupled directly between the grid sections and the row lines. In one embodiment, the diodes are formed in an insulative layer carrying the grid sections. In another embodiment, the diodes are integrated into the emitter substrate.

2 Claims, 3 Drawing Sheets

MATRIX ADDRESSABLE DISPLAY WITH ELECTROSTATIC DISCHARGE PROTECTION

STATEMENT AS TO GOVERNMENT RIGHTS

This invention was made with government support under Contract No. DABT 63-93-C-0025 awarded by Advanced Research Projects Agency ("ARPA"). The government has certain rights in this invention.

TECHNICAL FIELD

The present invention relates to electrostatic discharge protection in matrix addressable displays.

BACKGROUND OF THE INVENTION

Flat panel displays are widely used in a variety of applications, including computer displays. One suitable flat panel display is a field emission display. Field emission displays typically include a generally planar emitter substrate covered by a display screen. A surface of the emitter substrate has formed thereon an array of surface discontinuities or "emitters" projecting toward the display screen. The emitters are conical projections which may be integral to the substrate. Typically, contiguous groups of emitters are grouped into emitter sets in which the emitters in each emitter set are commonly connected.

The emitter sets are typically arranged in an array of columns and rows, and a conductive extraction grid is positioned above the emitters. The extraction grid includes small openings into which the emitters project. All, or a portion, of the extraction grid is driven with a voltage of about 30–120 V. Each emitter set is then selectively activated by applying a voltage to the emitter set. The voltage differential between the extraction grid and the emitter sets produces an electric field extending from the extraction grid to the emitter set having a sufficient intensity to cause the emitters to emit electrons.

The display screen is mounted directly above the extraction grid. The display screen is formed from a glass panel coated with a transparent conductive material that forms an anode biased to about 1–2 kV. The anode attracts the emitted electrons, causing the electrons to pass through the extraction grid. A cathodoluminescent layer covers a surface of the anode facing the extraction grid so that the electrons strike the cathodoluminescent layer as they travel toward the 1–2 kV potential of the anode. The electrons striking the cathodoluminescent layer cause the cathodoluminescent layer to emit light at the impact site. Emitted light then passes through the anode and the glass panel where it is visible to a viewer. The light emitted from each of the areas thus becomes all or part of a picture element or "pixel."

The brightness of the light produced in response to the emitted electrons depends, in part, upon the rate at which electrons strike the cathodoluminescent layer. The light intensity of each pixel can thus be controlled by controlling the current available to the corresponding emitter set. To allow individual control of each of the pixels, the electric potential between each emitter set and the extraction grid is selectively controlled by a column signal and a row signal through corresponding drive circuitry. To create an image, the drive circuitry separately establishes current to each of the emitter sets.

To produce the intense electric field that extracts electrons from the emitters, the openings into which the emitters project are very small. Consequently, the distances between the emitters and the grid sections are very short. If the voltage differential between the emitters and the grids is too high, electrons will be extracted from the emitters at a rate that is sufficient to damage the emitters. Such high differential voltages can occur during packaging and handling due to statically induced charge on either the emitters, the extraction grid or the anode.

SUMMARY OF THE INVENTION

A field emission display includes an electrostatic discharge ("ESD") circuit coupled to discharge statically induced charge, thereby reducing damage to the field emission display. In one embodiment of the invention, the field emission display includes an emitter substrate having a plurality of emitters formed thereon and an extraction grid formed from a plurality of grid sections adjacent to the emitter substrate. The ESD circuit is coupled between the grid sections and the emitter substrate to provide a current path to discharge statically induced charge when the voltage differential between the grid section and the emitter substrate exceeds a selected voltage. The ESD circuit preferably includes diodes having their anodes coupled to the emitter substrate and cathodes coupled to the grid sections.

In another embodiment of the invention, the ESD circuit includes a first portion coupled between the grid sections and a first reference potential and a second portion coupled between the emitter substrate and a second reference potential. The first portion is formed from a plurality of column protection diodes and the second portion is formed from a plurality of row protection diodes. In this embodiment, the first portion of the ESD circuit discharges statically induced charge when the voltage differential between the grid section and the first reference potential exceeds a selected first voltage. The second portion provides a current path to discharge statically induced charge from the emitter substrate when the voltage differential between the emitter substrate in the second potential exceeds a second selected voltage.

In one embodiment of the invention, the ESD circuit is formed from pn junctions integrated into the emitter substrate. In another embodiment of the invention, the ESD circuit is formed from pn junctions formed within an insulative layer carrying the grid sections.

In another embodiment of the invention, the field emission display also includes an ESD diode coupled between a transparent conductive anode on the display screen and a reference pad. The ESD diode has a breakdown voltage that exceeds the expected operating voltage of the transparent anode, so that the ESD diode only discharges the transparent anode when the voltage of the transparent anode is above its expected operating voltage.

DETAILED DESCRIPTION OF THE INVENTION

Figure 1:
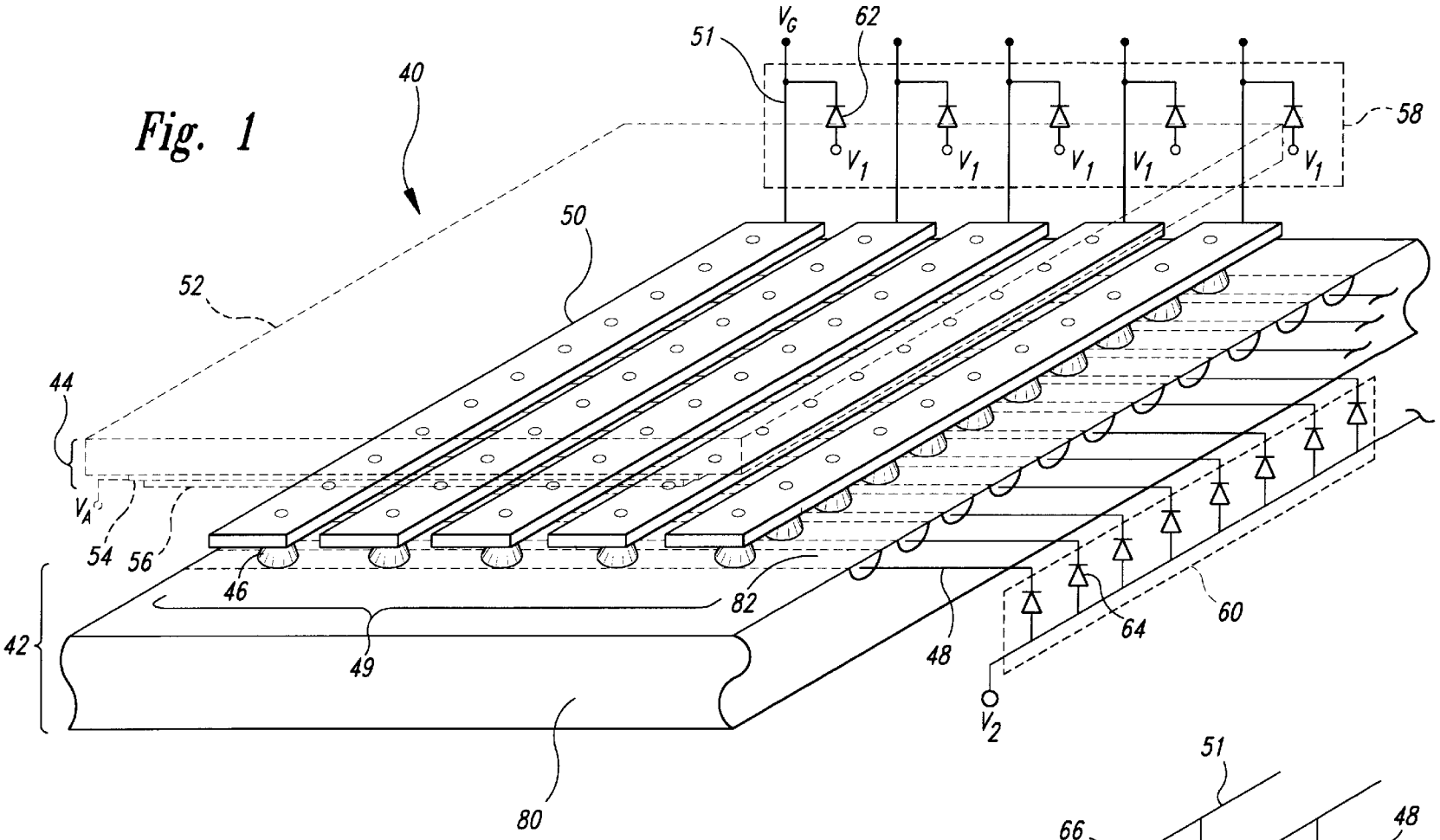
FIG. 1 is an isometric view of a portion of a field emission display showing an emitter substrate and grid sections each coupled to respective sets of protection diodes where a display screen covering the emitter substrate and grid sections is shown in shadow.

As shown in FIG. 1, a field emission display 40 includes an emitter substrate 42 and a display screen 44. The emitter substrate 42 includes an array of emitter sets 46 on an upper surface of a semiconductor substrate 80. The emitter sets 46 are arranged in rows and columns with the emitter sets 46 in each row connected by n-regions 82 in the substrate 80. The n-regions 82 are each coupled to respective row lines 48. Although the emitter substrate 42 is represented by an array of only eleven rows and five columns for clarity of presentation, one skilled in the art will recognize that such emitter substrates 42 typically are formed from an array of hundreds of rows with each row having hundreds of emitter sets 46. Also, although each emitter set 46 is represented by a single conical emitter, one skilled in the art will recognize that such emitter sets 46 typically include several emitters that are commonly connected.

Figure 4:
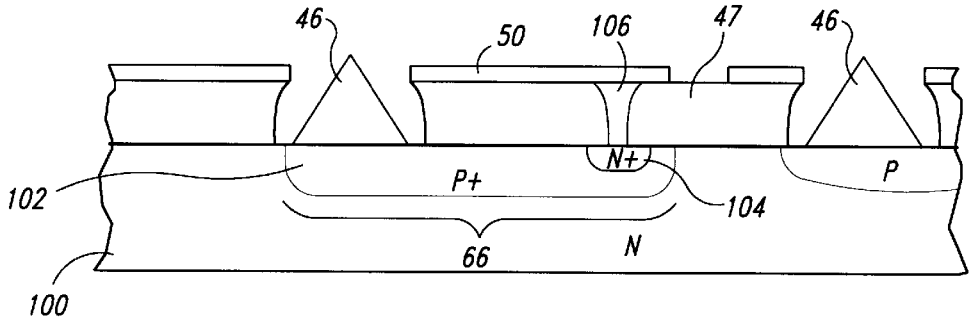
FIG. 4 is a side cross-sectional view of a portion of an emitter substrate showing a protection diode integrated into the emitter substrate and connected to a grid section.
Figure 5:
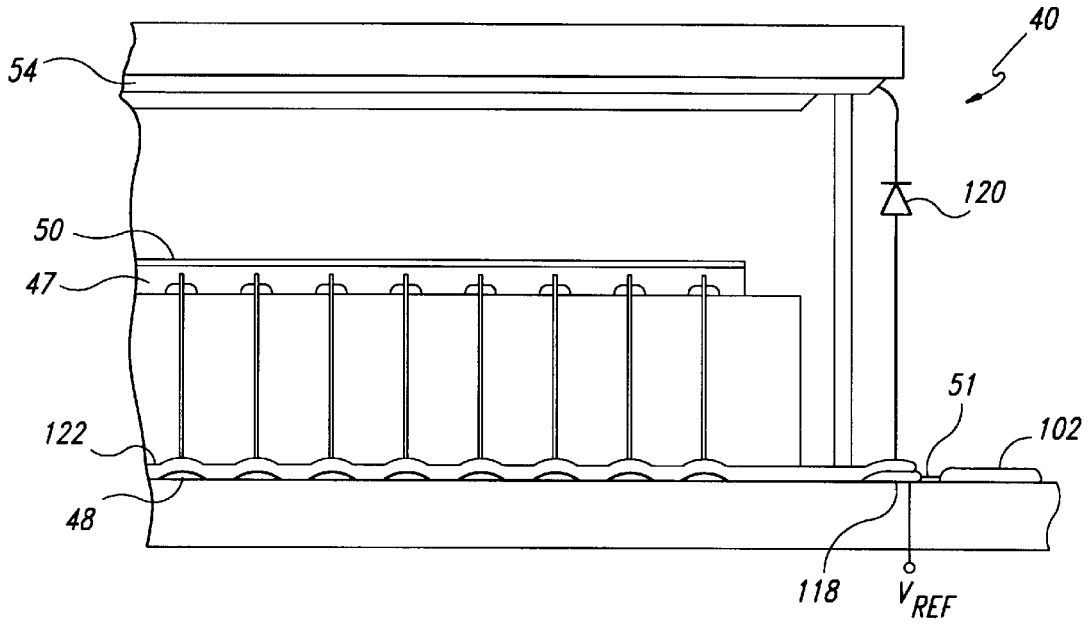
FIG. 5 is a side cross-sectional view in detail of a portion of a field emission display including an ESD diode coupled between a transparent anode and a reference potential and showing ESD protective tape covering a set of bonding pads.
Figure 6:
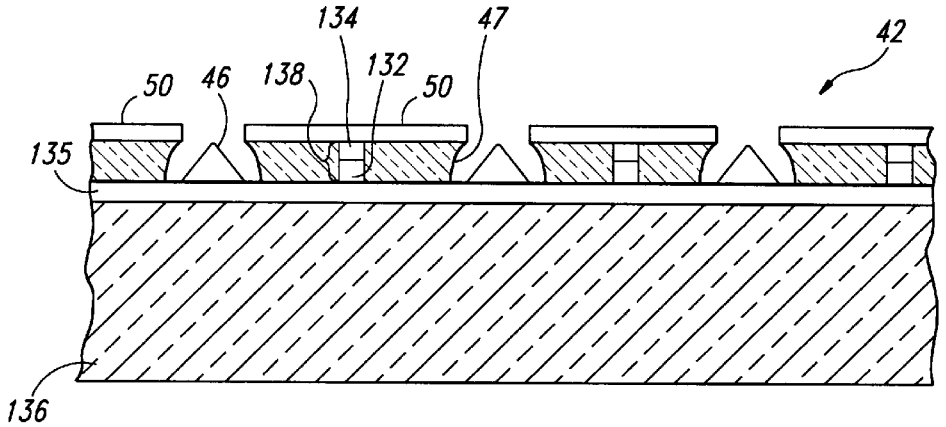
FIG. 6 is a side cross-sectional view in detail of an emitter substrate formed on a glass base and including diodes formed within an insulative layer carrying an extraction grid.

A conductive extraction grid 49 having several grid sections 50 is positioned above the emitter substrate 42 atop an insulative layer 47 (removed for clarity of presentation in FIG. 1, but visible in FIGS. 4, 5 and 6). The grid sections 50 are aligned along respective columns, each of which intersect all of the rows of emitter sets 46 on the emitter substrate 42. Each of the grid sections 50 is connected to a respective column line 51.

The screen 44 is a conventional field emission display screen positioned opposite the emitter substrate 42 and the grid sections 50. As is conventional, the screen 44 includes a transparent panel 52 having a transparent conductive anode 54 on a surface facing the emitter substrate 42. A cathodoluminescent layer 56 coats the anode 54 between the anode 54 and the grid sections 50.

In operation, selected ones of the column lines 51 are biased at a grid voltage $V_G$ of about 30–120 V and the anode 54 is biased at a high voltage $V_A$, such as 1–2 kV. If an emitter set 46 is connected to a voltage that is sufficiently lower than the grid voltage $V_G$, for example, 0 volts, the voltage difference between the grid section 50 and the emitter set 46 produces an intense electric field between the grid section 50 and the emitter set 46 in a row intersecting the grid section 50. The electric field causes the emitter set 46 to emit electrons according to the Fowler-Nordheim equation. The emitted electrons are attracted by the high anode voltage $V_A$ and travel toward the anode 54 where they strike the cathodoluminescent layer 56, causing the cathodoluminescent layer 56 to emit light around the impact site. The emitted light passes through the transparent anode 54 and the transparent panel 52 where it is visible to an observer.

The intensity of light emitted by the cathodoluminescent layer 56 depends upon the rate at which electrons emitted by the emitter sets 46 strike the cathodoluminescent layer 56. The rate at which the emitter sets 46 emit electrons is controlled in turn by the voltage difference between the grid section 50 and the intersecting emitter set 46. The voltage difference is produced in control circuitry (not shown) in response to an input signal $V_{IN}$.

Unlike a conventional field emission display, the field emission display 40 includes electrostatic discharge (ESD) circuits 58, 60 coupled to the column lines 51 and row lines 48. The column ESD circuit 58 is formed from separate column protection diodes 62 having their cathodes coupled to the column lines 51 and their anodes coupled to a first reference voltage $V_1$. The row ESD circuit 60 is formed from separate row protection diodes 64 having their cathodes coupled to separate row lines and their anodes coupled to a second reference voltage $V_2$. The protection diodes 62, 64 are discrete diodes having well-defined reverse-bias breakdown voltages on the order of 200 V–500 V and formed according to conventional ESD diode techniques. The first and second reference voltages $V_1$, $V_2$ are preferably ground although other voltages may be used, depending upon the application.

The effect of the protection diodes 62, 64 can best be seen by considering the relative voltages of the grid sections 50 and the emitter sets 46. In a conventional display, handling, packaging or operation of the emitter substrate 42 may induce a static charge that can raise the voltage of the row lines 48 or column lines 51 to several thousand volts above ground. When the other of the row or column lines 48, 51 is grounded, the resulting voltage difference between a grid section 50 and a respective emitter set 46 produces a very intense electric field. The intense electric field causes the emitter set 46 to emit electrons very rapidly. The emitter set 46, due to the small size of the individual emitters, is unable to sustain the high flow of electrons without damage. Consequently, the electron flow damages or destroys the emitter set 46.

In the display 40 of FIG. 1, when the row or column line 48, 51 is raised to a high voltage relative to the first of second references voltages $V_1$, $V_2$, the respective protection diodes 62, 64 break down quickly. The broken down protection diodes 62, 64 form a current path to discharge statically induced charge to the respective reference potentials $V_1$, $V_2$. The voltage differential between the emitter sets 46 and grid sections 50 thus remains below a level that would cause significant damage to the emitter sets 46.

Figure 2:
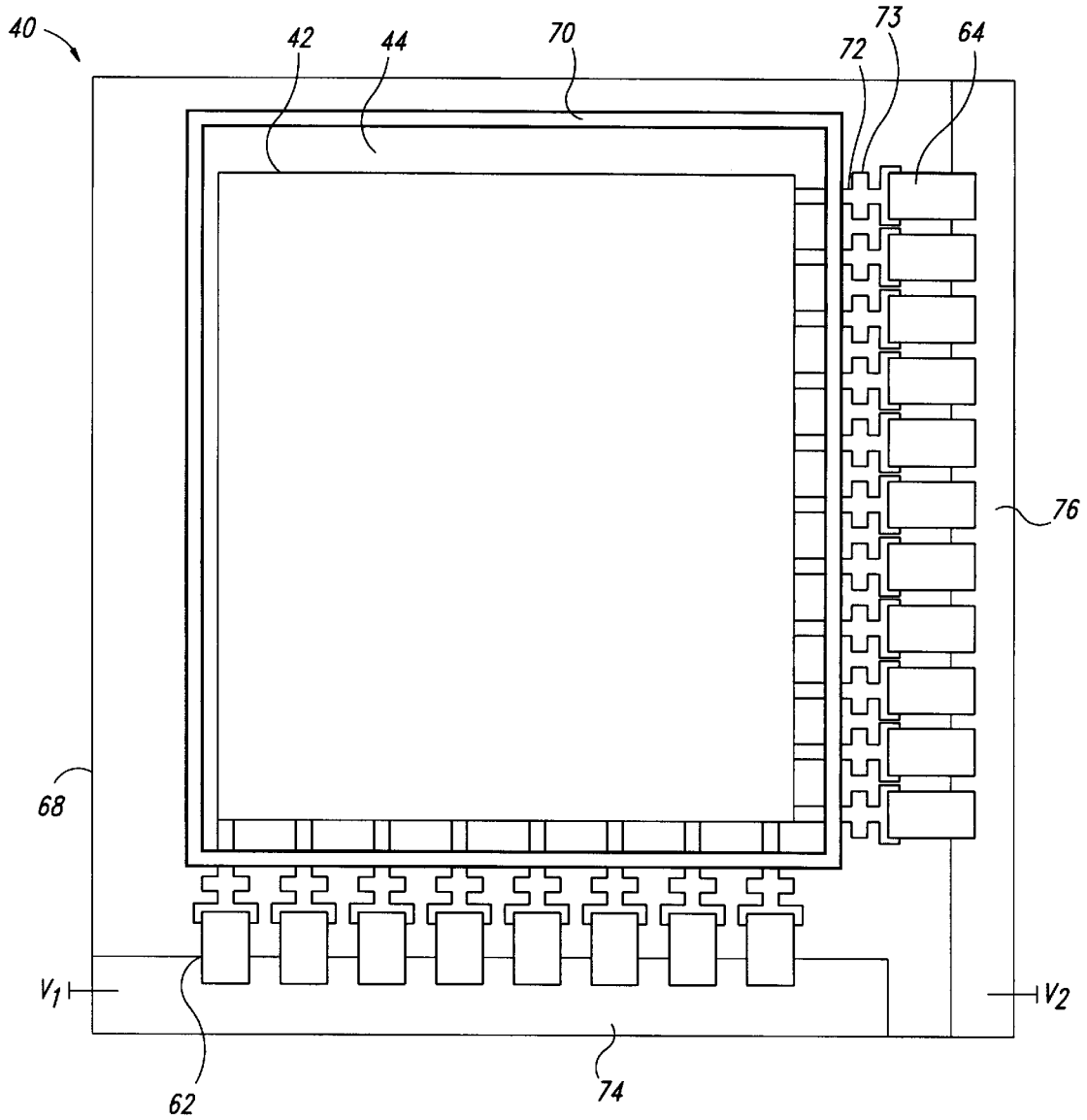
FIG. 2 is a top plan view of a field emission display showing protection diodes coupled to respective row and column lines where the protection diodes are mounted outside of a package containing the emitter substrate.

FIG. 2 shows one approach to packaging the ESD-protected field emission display 40 where the emitter substrate 42 is mounted to a base 68 and surrounded by a frame 70. The display screen 44 is sealed to the frame 70 such that the base 68, frame 70 and display screen 44 together form a sealed package containing the emitter substrate 42. Conductive traces 72 are formed on an upper surface of the base 68 and extend from within the sealed frame 70 to an exposed region of the base 68. The traces 72 are conventional conductive traces formed through conventional methods, such as photolithographic patterning. The traces 72 do not break the seal, because the frame 70 is sealed to the base 68 and the traces 72 with a hermetic seal. Each of the traces includes a bonding pad 73 to allow connection to the respective row or column line 48, 51.

The upper surface of the base 68 includes a pair of large conductive reference pads 74, 76 connected to the first and second reference potentials $V_1$, $V_2$, respectively. The protection diodes 62, 64 extend from the respective traces 72 to the respective reference pads 74, 76, respectively. The protection diodes 62, 64 are electrically connected to the traces 72 and the reference pads 74, 76 through conventional surface mounted bonding techniques, such as solder or conductive epoxy.

Figure 3:
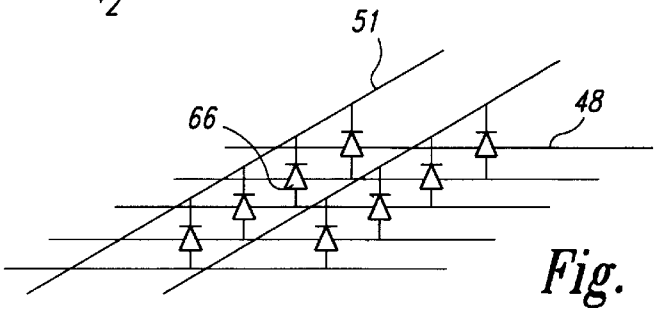
FIG. 3 is a diagrammatic representation of a set of protection diodes coupled between respective grid sections and row lines of an emitter substrate.

FIG. 3 shows diagrammatically an alternative embodiment where protection diodes 66 are coupled directly between the column lines 51 and the row lines 48. This embodiment eliminates the separate row and column protection diodes 62, 64 of FIG. 1.

In this embodiment, the protection diodes 66 prevent the voltage of the row lines 48 from exceeding the voltage of the grid sections 50 by more than the forward breakdown voltages of the protection diodes 66. Additionally, the protection diodes 66 provide a discharge path for electrons when the voltage of the column lines 51 exceeds the voltage of the row lines 48 by the reverse-bias breakdown voltage of the protection diodes 66.

FIG. 4 shows one implementation of the field emission display 40 of FIG. 3 where the emitter sets 46 and protection diodes 66 are integrated into an n-type semiconductor substrate 100. The emitter sets 46 are formed from p-type material on respective p-wells 102 in the n-type substrate 100, and the protection diodes 66 are produced by forming respective n+ regions 104 in the p-well 102. The p-well 102 thus forms the anode of the protection diode 66 and the n+ region 104 forms the cathode. The p-well 102 also extends across the substrate 100 and connects to the row line 48. To prevent the pn junction between the p-well 102 and the n-type substrate 100 from conducting, the n-type substrate 100 is biased to a positive voltage. The n+ region 104 is connected to the respective grid section 50 through a conductive via 106 that passes through the insulative layer 47. When the voltage of the grid section 50 exceeds the voltage of the row line 48 (FIG. 1) by more than the reverse bias breakdown voltage of the protection diode 66, the protection diode 66 conducts electrons from the row line to the grid section 50. When the voltage of the row line 48 exceeds the voltage of the grid section 50 by the forward bias voltage of the protection diode 66, the protection diode 66 conducts electrons from the grid section 50 to the row line 48.

FIG. 5 shows another embodiment of the field emission display 40 in which the transparent conductive anode 54 is protected against electrostatic discharge by a high voltage ESD diode 120 having its cathode connected to the transparent anode 54. The anode of the ESD diode 120 is connected to a reference trace 118 held at a reference voltage $V_{REF}$. The ESD diode 120 has a breakdown voltage of approximately 1500–2500 V. This is higher than that of the previously described protection diodes 62, 64, because the transparent anode 54 operates at approximately 1–2 kV which would break down the 200–500 V diodes 62, 64, 66 described previously.

As with the protection diodes 62, 64 described above, the ESD diode 120 provides a current path to discharge statically induced charges when the voltage of the transparent anode 54 rises above the reference voltage $V_{REF}$ by more than the breakdown voltage of the ESD diode 120. The ESD diode 120 therefore prevents statically induced charge from arcing between the transparent anode 54 and other locations within the field emission display 40, such as the grid sections 50 or the emitter sets 46 (FIG. 1).

To provide additional ESD protection during packaging, and shipping, strips of ESD tape 122 are attached to the row lines 48 and column lines 51. ESD tape 122 is a commercially available conductive tape. The ESD tape 122 connects all of the row lines 48 and/or column lines 51 to the reference potential $V_{REF}$. The ESD tape 122 is removed once the field emission display 40 is ready for operation so that the voltages of the row lines 48 and column lines 51 can be controlled independently.

FIG. 6 shows another embodiment of the invention in which the emitter sets 46 are formed on chrome row lines 135 on an upper surface of a glass substrate 136. In this embodiment, ESD diodes 138 are formed in the insulative layer 47 that carries the grid sections 50. The ESD diodes 138 are formed by etching a hole through the insulative layer 47 to expose the row lines 135. Then, an n-region 132 is deposited in the hole directly on the row line 125. Next, a p-region 134 is deposited within the hole, atop the n-region 132 such that the interface between the p-region 134 and n-region 132 forms a pn junction. When the grid sections 50 are formed by depositing and patterning a conductive material, such as chrome, on the insulative layer 47, the conductive material of the grid sections 50 covers the p-regions 134, forming electrical connections thereto. The cathodes of the diodes 138 are thus coupled to the row lines 135 and the anodes of the diodes 138 are coupled to the grid sections 50. One skilled in the art will recognize that the processing steps above may be modified depending upon the particular application. For example, where the grid sections 50 for the row lines 135 are metal, p+ and n+ regions may be formed in the p-region 134 and n-region 132 to improve electrical contact between the ESD diodes 138 and the grid section 50 and/or row line 135.

From the foregoing, it will be appreciated that although exemplary embodiments of the invention have been described herein for purposes of illustration, various modifications may. be made without deviating from the spirit and scope of the invention. For example, although the row protection diodes 64 of FIG. 1 are shown as being commonly coupled to the second reference potential $V_2$, one skilled in the art will recognize that the row protection diodes 64 can be coupled separately to respective reference potentials. Similarly, the diode structure of FIG. 6 can be adapted for implementation with semiconductor substrates. Further, the ESD protection circuits described herein need not be diodes. Other ESD protective circuits, such as bipolar transistors, can also be used. Also, the ESD diode 120 and ESD tape 122 of the embodiment of FIG. 5 can be combined with any of the other embodiments described herein. Accordingly, the invention is not limited, except as by the appended claims.

We claim:

1. A field emission display, comprising:

a baseplate comprising:

a substrate having a surface on which a layer of conductive material is formed;

a plurality of emitters mounted on the substrate and coupled to the conductive material;

an extraction grid positioned adjacent to the substrate, the extraction grid having a plurality of openings aligned with respective emitters;

a dielectric material between the conductive material and coupled between the conductive material and the extraction grid; and an electrostatic discharge device integrally formed with the baseplate, the electrostatic discharge device coupled between at least some of the emitters and the extraction grid, the electrostatic discharge device being operable to conduct current when a voltage differential between the extraction grid and respective emitter has a magnitude that exceeds a maximum voltage wherein the electrostatic discharge device comprises a diode fabricated in the dielectric material and coupled between the conductive material and the extraction grid; and a faceplate positioned opposite and in parallel with the baseplate, the faceplate comprising:

a transparent viewing screen;

a layer of transparent conductive material coating a surface of the transparent viewing screen facing the emitters; and a layer of cathodoluminescent material coating the layer of transparent conductive material.

2. A field emission display, comprising:

a baseplate comprising:

a substrate having a surface on which a layer of conductive material is formed;

a plurality of emitters coupled to the conductive material;

an extraction grid positioned adjacent to the substrate, the extraction grid having a plurality of openings aligned with respective emitters;

a dielectric material between the conductive material and the extraction grid; and an electrostatic discharge device fabricated in the dielectric material, the electrostatic discharge device being coupled between the conductive material and the extraction grid, the electrostatic discharge device being operable to conduct current when a voltage differential between the extraction grid and respective emitter has a magnitude that exceeds a maximum voltage; and a faceplate positioned opposite and in parallel with the baseplate, the faceplate comprising:

a transparent viewing screen;

a layer of transparent conductive material coating a surface of the transparent viewing screen facing the emitters; and a layer of cathodoluminescent material coating the layer of transparent conductive material.

* * * * *